US005649058A

United States Patent [19]

Lee

[11] Patent Number: 5,649,058

[45] Date of Patent: Jul. 15, 1997

[54] SPEECH SYNTHESIZING METHOD ACHIEVED BY THE SEGMENTATION OF THE LINEAR FORMANT TRANSITION REGION

[75] Inventor: Yoon-Keun Lee, Seoul, Rep. of Korea

[73] Assignee: Gold Star Co., Ltd., Seoul, Rep. of Korea

[21] Appl. No.: 236,150

[22] Filed: May 2, 1994

Related U.S. Application Data

[63] Continuation of Ser. No. 952,136, Sep. 28, 1992, abandoned, which is a continuation of Ser. No. 677,245, Mar. 29, 1991, abandoned.

[30] Foreign Application Priority Data

Mar. 31, 1990 [KR] Rep. of Korea ..... 4442/1990

[51] Int. Cl.[6] ..... G10L 7/02; G10L 9/02

[52] U.S. Cl. ..... 395/2.77; 395/2.74; 395/2.18

[58] Field of Search ..... 395/2, 2.67, 2.76, 395/2.77, 2.18, 2.74; 381/50–53

[56] References Cited

U.S. PATENT DOCUMENTS

| | | | |
|---|---|---|---|
| 3,828,131 | 8/1974 | Flanagan et al. | 395/2.77 |
| 4,128,737 | 12/1978 | Dorais | 395/2.74 |
| 4,130,730 | 12/1978 | Ostrowski | 395/2.73 |
| 4,264,783 | 4/1981 | Gagnon | 395/2.7 |
| 4,433,210 | 2/1984 | Ostrowski et al. | 395/2.74 |
| 4,542,524 | 9/1985 | Laine | 395/2.78 |
| 4,689,817 | 8/1987 | Kroon | 395/2.69 |
| 4,692,941 | 9/1987 | Jacks et al. | 395/2.69 |
| 4,829,573 | 5/1989 | Gagnon et al. | 395/2.7 |

*Primary Examiner*—Allen R. MacDonald
*Assistant Examiner*—Talivaldis Smits

[57] ABSTRACT

A way of a synthesizing speech by the combination of a Speech coding mode and Formant analysis mode is achieved by segmenting a Formant transition region into portions, according to the linear characteristics of a frequency curve, and storing the Formant information of each portion. Therefrom frequency information of a sound is obtained. Formant information data of a Formant contour to produce speech, is calculated by a linear interpolation method. The frequency and the bandwidth, which are elements of the Formant contour calculated by a linear interpolation method, are sequentially filtered in order to produce a speech signal which is a digital speech signal. The digital speech signal is converted to an analog signal, amplified, and output through a external speaker.

16 Claims, 3 Drawing Sheets

$$\begin{pmatrix} F11 & BW11 & F12 & BW12 & F13 & BW13 & F14 & BW14 & L1 \\ F21 & BW21 & F22 & BW22 & F23 & BW23 & F24 & BW24 & L2 \\ & & & & & & & & \\ Fn1 & BWn1 & Fn2 & BWn2 & Fn3 & BWn3 & Fn4 & BWn4 & L3 \end{pmatrix}$$

SPEECH SYNTHESIZING METHOD ACHIEVED BY THE SEGMENTATION OF THE LINEAR FORMANT TRANSITION REGION

This application is a continuation of application Ser. No. 07/952,136 filed on Sep. 28, 1992; which is a rule 62 continuation of prior application Ser. No. 07/677,245 filed on Mar. 29, 1991; both now abandoned.

BACKGROUND OF THE INVENTION

1. Field of the Invention

The present invention relates to a speech synthesizing method by the segmentation of the linear Formant transition region and more particularly, to a mode to synthesize speech by the combination of a speech coding mode and a Formant analysis mode.

2. Description of the Prior Art

Generally, the mode of speech synthesis is classified into a speech coding mode and a Formant frequency analysis mode. After such a speech coding mode, the speech signal, relating to a whole phoneme including a syllable of the speech or a semi-syllable of the speech, is analyzed by a mode of a linear predictive coding (LPC) or a line spectrum pair (another representation for LPC parameters), and stored in a data base. The speech signal is then extracted from the data base for synthesizing. However, although such a speech coding mode can obtain a better sound quality, it requires an increase of data quantity since the speech signal must be divided into an interval frame (a short-time frame) for analyzing. Thus, there are a number of problems. For example, memory quantity must be increased and processing speed must be slowed down because data must be generated, even if the data is in a region where the frequency characteristics of the speech signal remains unchanged.

Also such a Formant frequency analysis mode is used to extract the basic Formant frequency and the Formant bandwidth, and synthesize the speech corresponding to an arbitrary sound by executing a regulation program after normalizing the change of the Formant frequency, which occurs in conjunction with a phoneme. However, it is difficult to find out the regulation of the change. Further, there exists the problem of slowing down the processing speed since the Formant frequency transition must be processed by a fixed regulation of the change.

SUMMARY OF THE INVENTION

Accordingly, it is an object of the present invention to provide an improved speech synthesizing method by the segmentation of the linear Formant transition region.

Another object of the present invention is to provide a mode to synthesize speech by the combination of a speech mode and the Formant analysis mode.

A further object of the present invention is to provide a method for synthesizing speech by decreasing the data quantity so as to store, in the memory, only points of linear characteristic change of the Formant frequency after segmenting the Formant frequency transition region into portions where the frequency curve is changing in linear characteristics.

Still another objective of the present invention is to provide a method for synthesizing a high quality sound and concisely analyzing the Formant frequency and bandwidth by using only the segmented information of the Formant linear transition region.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a method of synthesizing speech by the combination of a Speech coding mode and a Formant analysis mode by segmenting the Formant transition region according to the linear characteristics of the frequency curve and storing the Formant information (frequency and bandwidth) of each portion. Therefrom, frequency information of a sound is obtained. Formant contour data is used to produce speech, being calculated by a linear interpolation method. The frequency and the bandwidth are elements of the Formant contour calculated by the linear interpolation method. They are sequentially filtered in order to produce a speech signal which is a digital speech signal. The digital speech signal is then converted to an analog signal, amplified, and output through an external speaker.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figures 1, 4:
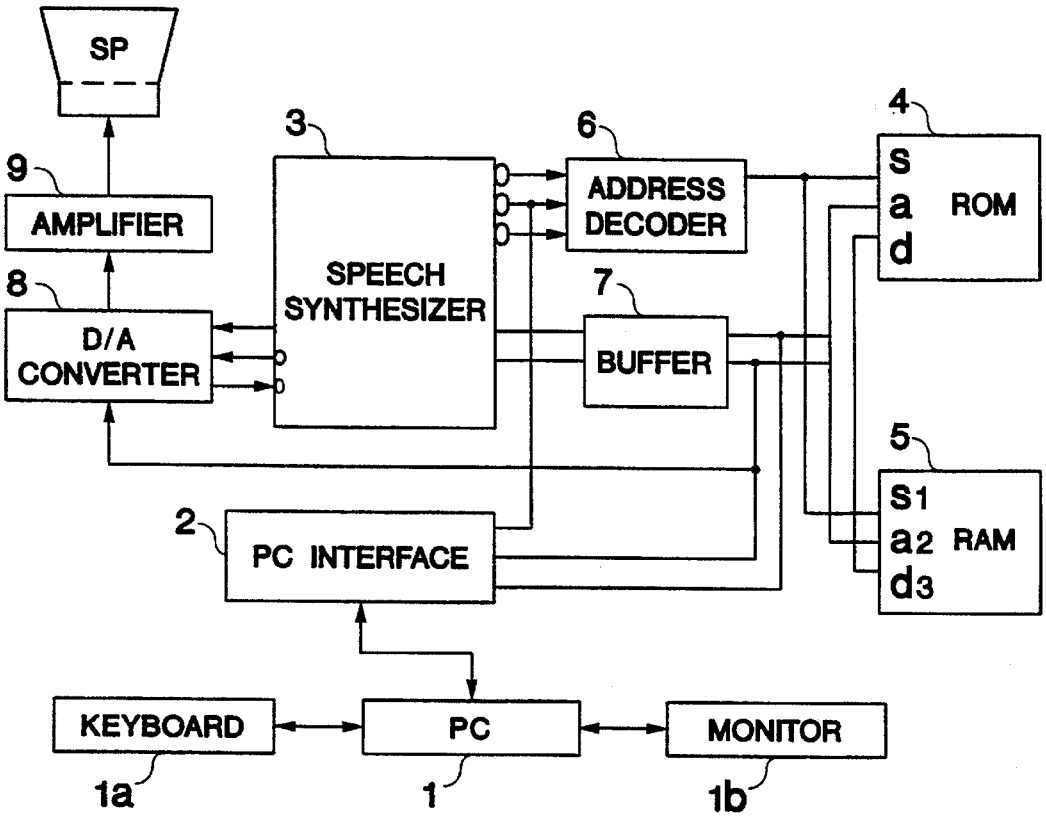
FIG. 1 shows a block diagram circuit for embodying the speech synthesis system according to the present invention.
FIG. 4 illustrates a data structure stored in the ROM.
Figure 5:
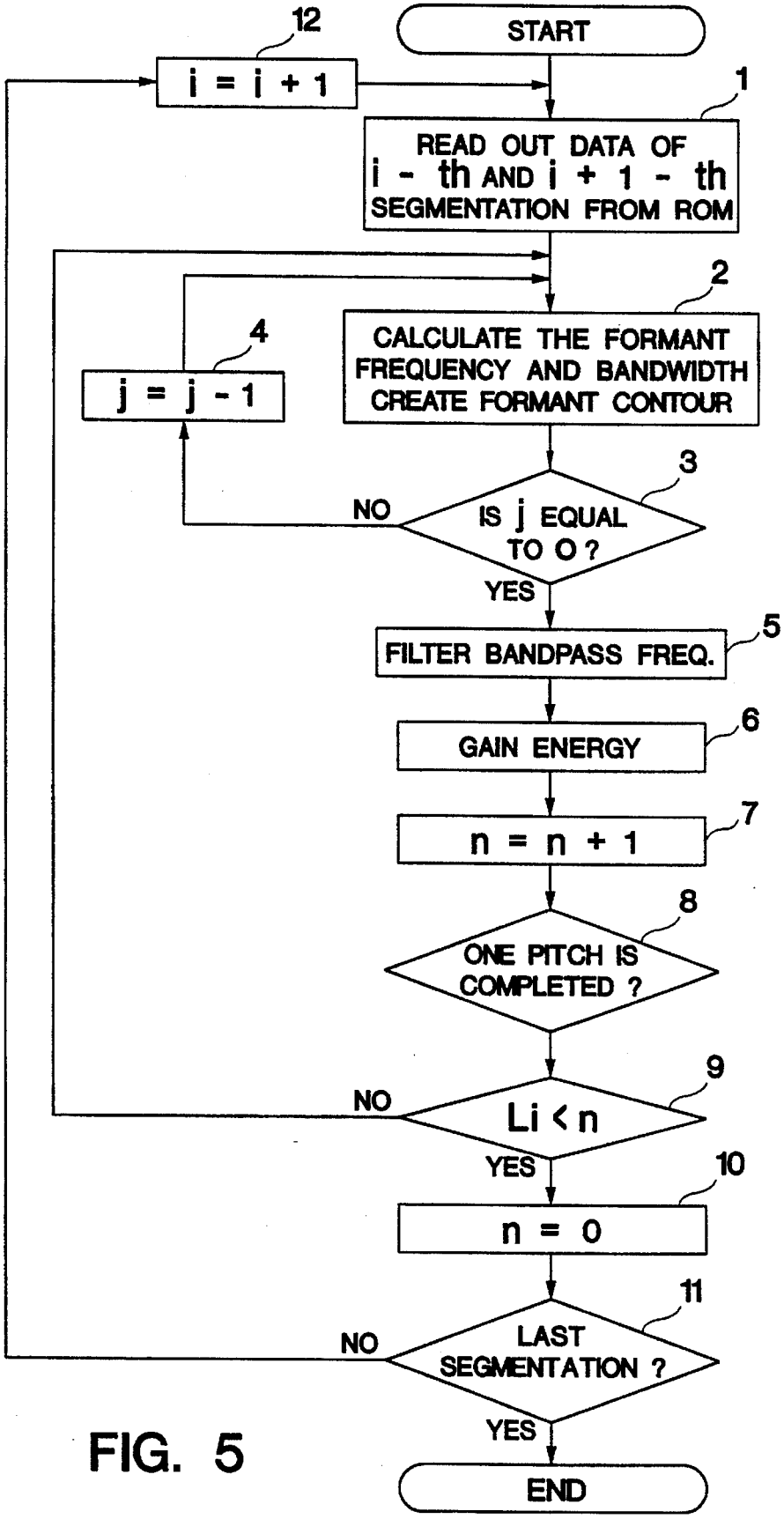
FIG. 5 shows a flow chart according to the present invention.

Referring now in detail to the drawings for the purpose of illustrating preferred embodiments of the present invention, the speech synthesizing method by segmentation of the linear Formant transition region, as shown in FIGS. 1 and 5, includes a personal computer 1, a speech synthesizer 3, a PC interface 2 disposed between the personal computer 1 and the speech synthesizer 3, a D/A converter 8, and a memory member including a ROM 4 and a RAM 5. FIG. 1 is a system block diagram for embodying the speech synthesis mode by the Formant linear transition segmentation process according to the present invention. The system according to the present invention as shown in FIG. 1, includes the personal computer 1 (hereinafter "PC") for inputting a character data (representative of speech to be synthesized, such as the word "Ya") to the speech synthesizer 3 through a keyboard 1*a* (or through an alternate input device such as a mouse via monitor 1*b* connected to PC 1) in order to synthesize a speech in the speech synthesizer 3, for executing the program for synthesizing the speech. The PC interface 2 connects the PC 1 to the speech synthesizer 3 and is for exchanging the data between the PC 1 and the speech synthesizer 3 and converting input data to a workable code. The Memory member, including ROM 4 and RAM 5, is for storing the program which is executed by the speech synthesizer 3 and for storing the Formant information data in order to synthesize the speech. The system further comprises an address decoder 6, connecting the speech synthesizer 3 to the ROM 4 and the RAM 5, for decoding a selector signal from the speech synthesizer 3 and storing the decoded selector signal in the memory member (ROM and RAM). A D/A converter 8 is included for converting the digital speech signal from the speech synthesizer 3 to an analog signal. Further, an amplifier 9 is connected to D/A converter 8 and is for amplifying the analog signal from D/A 8. An external speaker SP is connected to amplifier 9, for outputting the analog speech signal in audible form.

Figure 2:
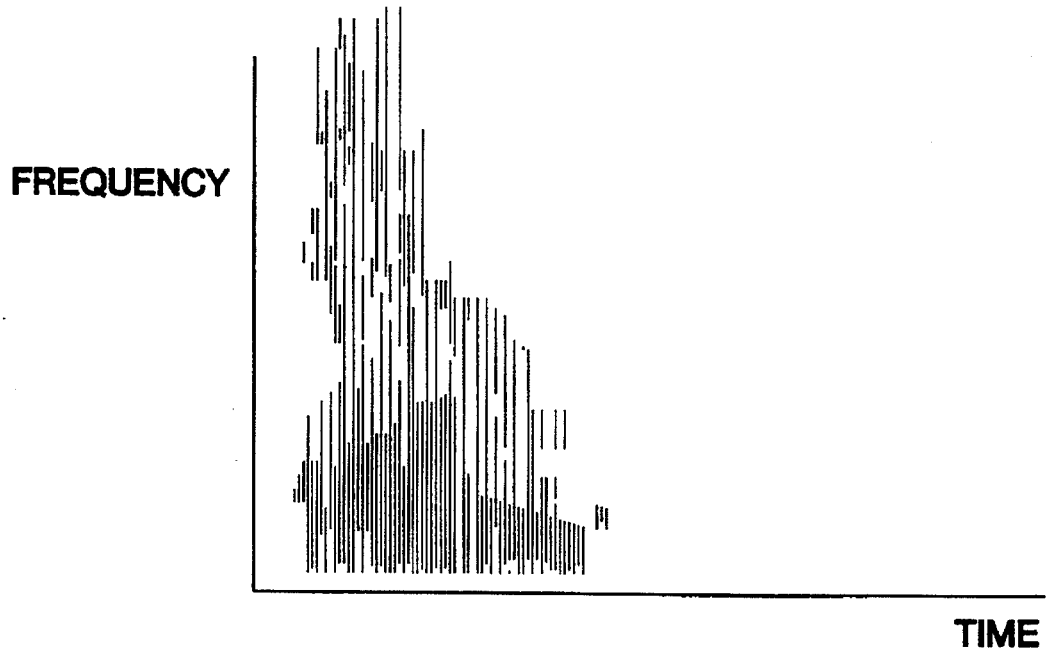
FIG. 2 shows a sonograph for the sound "Ya"
Figure 3:
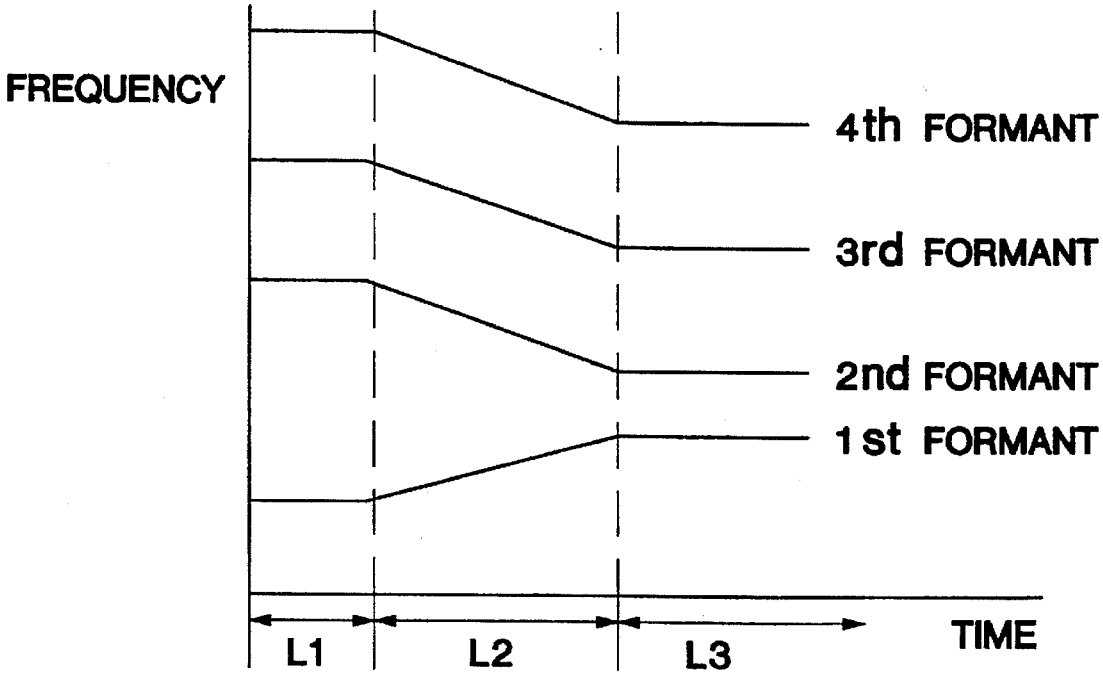
FIG. 3 illustrates a formant modeling of the sound "Ya"

A speech frequency signal is segmented into a plurality of segments "i" ("i" being an integer representing the segmentation index) based upon change of linear characteristics in the Formant linear transition region, as shown in FIG. 3, which is derived from FIG. 2 of a sonograph for the sound "Ya", for example. The Formant frequency graph of FIG. 3 shows the relation among the Formant frequency (hereinafter "Fj", wherein "j" is an integer representing the first, second, third, et. Formant and wherein "Fj" represents the corresponding frequency), bandwith (hereinafter "Bwj", representing the frequency bandwidth of each corresponding Formant) and the length of segment (hereinafter "Li", being a time value representing segment length, each segment i being obtained based upon a change in linear characteristics) which are stored in ROM 4 by a configuration shown in FIG. 4 for example, for each sound. Similar data is derived and stored, in a manner shown in FIG. 4 for example, for each of a plurality of sounds to thereby configure a data base.

The process for synthesizing a speech according to the present invention will now be described in detail referring to the flow chart of FIG. 5 and the above-mentioned system block diagram, as follows. After configuring the structure of a data base for a whole phoneme in a sound, and storing in a ROM of the memory member, character data of the sound desired, such as "Ya", is input through the keyboard la of the PC 1. It is then coded into an ASCII code through the PC interface 2. Thereafter, the ASCII code is applied to the speech synthesizer 3 in order to obtain synthesized speech corresponding to the input character data. The synthesized signal, which is a digital signal when output from speech synthesizer 3, is converted to an analog speech signal by D/A converter 8 for input to the amplifier 9, which amplifies the signal energy. The speech signal is subsequently output through the external speaker SP. Specific processing of the input data will subsequently be described.

Being that information stored in ROM 4 is only that corresponding to points of linear characteristic change of the Formant frequency, after segmenting the Formant Frequency transition region into portions, a complete speech digital signal necessary to synthesize speech corresponding to the input information, must be generated. Thus, a plurality of samples "n" are calculated (the sampling rate, and thus the duration of each sample "n", being a predetermined number based upon the specifications of a desired amplifier and speaker, to generate a high quality audible sound) to thereby synthesize the input sound. For each sample "n", the Formant value 1–4 (4 being exemplary here, and thus not limiting) and the Bandwidth value 1–4 must be calculated. These calculations are achieved for each sample, within each segment $L_i$, utilizing the stored information corresponding to a subsequent segment.

The coded character data (corresponding to the input character data) is applied to speech synthesizer 3 through the PC interface 2. To generate the necessary information of the first sample (n=1) of the first segment (i=1), the Formant frequency data for the fourth Formant Fj (j being 4) and the bandwidth information for the fourth bandwidth (j being 4), for both the first and second segments (thus $F_{14}$, $BW_{14}$ and $F_{24}$, $Bw_{24}$), are output from ROM 4 in 1 of FIG. 5. (It should be noted that the first Formant frequency and the first bandwidth could be calculated first, with j being incremented, instead of decremented and thus the present embodiment is merely exemplary). Thereafter, the appropriate portion (pitch) and energy of the Formant frequency can be calculated in 2 of FIG. 5 as follows.

The first Formant frequency (j=1) and first bandwidth (j=1) for each sample "n" is calculated by a linear interpolation method of the formula $$F_j=(F_{i+1,j}-F_{i,j})n/L_i$$

$$BW_j=(BW_{i+1,j}-BW_{i,j})n/L_i$$

wherein, Li is the length of segmentation i. Subsequently, in 3 of FIG. 5, it is determined whether or not j=o (thus, have each of the first to fourth, four being exemplary, Formants and Bandwidths been determined for sample n=1). Here, the answer is no, so j is decremented by one in 4 of FIG. 5. Thus, the second, third and fourth Formant and Bandwidth will be calculated in a similar manner as described with regard to the first Formant and Bandwidth, for the first sample "n".

The excitation signal thus generated, which is called a Formant contour corresponding to the Formant information calculated by the above formula, is then stored in buffer 7 and subsequently filtered, in 5 of FIG. 5, through a plurality of bandpass filters so as to generate a digital speech signal thereof. Thereafter, the digital speech signal is converted to an analog speech signal by D/A converter 8. The analog speech signal is then amplified by an energy level of amplifier 9 to increase speech energy in 6 of FIG. 5.

Subsequently, the sample index "n" is incremented in 7 of FIG. 5. Thus, the aforementioned 2–6 of FIG. 5 will be repeated to determine the Formant frequency and Bandwidth for sample n=2 in a manner similar to that previously described. In 8 and 9 of FIG. 5 it is determined whether or not one pitch (portion) is completed by comparing the sample index "n", now equal to 2 to the portion length of the portion $L_i$ (i being i for the first portion). If "n" is less than or equal to $L_i$ (here n=2 and $L_i$=12), then the above mentioned process is repeated for the remaining samples within the portion, thus returning to 2 in FIG. 5.

Upon "n" being greater than $L_i$, "n" is then initialized to zero in 10 of FIG. 5. It is determined in 11 of FIG. 5 whether or not this is the last segment i. If not, i is incremented in 12 of FIG. 5 and the process is repeated to determine the Formant and Bandwidth for j=(1–4) for each of the plurality of samples ("n") within the portion i (i now being 2). Finally, when the last segment is determined, the characteristic speech synthesis process is complete.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A method for synthesizing speech through a synthesizer system including a personal computer (PC), a PC interface, a speech synthesizer, a digital-to-analog (D/A) converter, a key-board, a memory, and a speaker, the method comprising the steps of:

(a) segmenting linear Formant information, corresponding to phoneme information, into linear Formant transition region segments;

(b) storing Formant frequency information and Formant bandwidth information for points of transition between consecutive ones of the linear Formant transition region segments of step (a), and lengths of the linear Formant transition region segments established by the segmenting in step (a), into a data base in a memory, for each phoneme information;

(c) inputting information subsequent to the storing in step (b), the input information designating speech sound to be synthesized;

(d) reading out stored Formant frequency information, Formant bandwidth information and length of the linear Formant transition region segments corresponding to the input information of step (c), from the data base stored in the memory;

(e) calculating a digital Formant contour, by linearly interpolating between the read out Formant frequency information and Formant bandwidth information corresponding to first and second consecutive points of transition corresponding to one of the linear Formant transition region segments of step (d), the interpolating being calculated over the read out length of the first linear Formant transition region segment;

(f) filtering the digital Formant contour, through a plurality of bandpass filters classified by a characteristic Formant, to produce a digital speech signal representative of a filtered glottal pulse; and (g) converting the digital speech signal representative of the filtered glottal pulse into an analog speech signal through the D/A converter and outputting the analog speech signal.

2. The method of claim 1, wherein the calculation of step (e) includes the steps of:

(e) (00) determining a number of samples to be calculated between the read out Formant frequency information of the first and second linear Formant transition region segments, and between the read out Formant bandwidth information of the first and second linear Formant transition region segments;

(e) (0) assigning a sample index value to designate a first one of the samples, and making a first linear interpolation calculation for the first sample;

(e) (i) determining whether, for the sample index value, the linear interpolation calculations have been completed for all Formants included in the read out frequency information and bandwidth information; and (e) (ii) if it is determined, in step (e) (i) that the linear interpolation calculations have been completed, then proceeding to filter, in step (f), the Formant contour and determining whether the sample index value, when incremented, is greater than the stored length of segmentation for the segmented linear Formant transition region.

3. The method of claim 2, wherein the calculation of step (e) further includes the steps of:

(e)(iii) determining whether or not the present linear Formant transition region segment is a last linear Formant transition region segment stored corresponding to the input information of step (c);

(e)(iv) returning to step (e)(00) to calculate the digital speech signal between a subsequent pair of points of transition corresponding to the next stored linear Formant transition region segment when the present linear Formant transition region segment is determined not to be the last linear Formant transition region segment in step (e)(iii); and (e)(v) completing the calculation of the digital speech signal corresponding to the input information of step (c) when the linear Formant transition region segment is determined to be the last stored linear Formant transition region segment in step (e) (iv).

4. A method of processing speech, comprising the steps of:

(a) segmenting a speech frequency signal at points of transition into a plurality of time segments, each segment having a time length and each point of transition including at least one Formant of the speech frequency signal;

(b) storing, for each Formant at each point of transition, one Formant frequency information and one bandwidth information; and (c) storing, for each segment, time length information corresponding to the time length of the segment obtained in said step (a).

5. The method of claim 4, wherein said step (a) determines respective time lengths according to points of linear characteristic change of the Formant's frequency, the points of linear characteristic change corresponding to the points of transition.

6. The method of claim 4, further comprising the steps of:

(d) reading, as first data, the stored Formant frequency information and the bandwidth information corresponding to a first point of transition;

(e) reading, as second data, the stored Formant frequency information and the bandwidth information corresponding to a second point of transition; and (f) calculating a plurality of frequency and bandwidth values based upon the first and second data.

7. The method of claim 6, wherein said step (f) includes the sub-steps of:

(f-1) determining a number of samples, n, to be calculated between the first and second data, the determination being based upon the stored time length information, Li, of a first time segment, i=1;

(f-2) for at least the one Formant, j=1, calculating the number, n, of Formant frequency values, each Formant frequency value, F, being calculated according to:

$$F=(F_{i+1,j}-F_{i,j})n/L_i$$

for n=1 to n, where $F_{i+1,j}$ and $F_{i,j}$ correspond, at i=1 and j=1, to the Formant frequency information read in said steps (d) and (e); and (f-3) for at least the one Formant, j=1, calculating the number, n, of bandwidth values, each bandwidth value, BW, being calculated according to:

$$BW=(BW_{i+1,j}-BW_{i,j})n/L_i$$

for n=1 to n, where $BW_{i+1,j}$ and $BW_{i,j}$ correspond, at i=1 and j=1, to the bandwidth information read in said steps (d) and (e).

8. The method of claim 7, wherein said sub-steps (f-1) to (f-3) are performed for each Formant stored at the first and second transition points.

9. The method of claim 7, wherein additional time segments consecutively follow the first time segment, said method further comprising the step of:

(g) repeating said step (f) for subsequent pairs of points of transition corresponding to the additional time segments.

10. A method of synthesizing speech, comprising the steps of:

(a) storing Formant information data for each of a plurality of Formants of a speech frequency signal, the Formant information data characterizing discrete points of transition between consecutive time segments of the speech frequency signal, the Formant information data including, for each point of transition, a single Formant frequency information and a single bandwidth information;

(b) reading, for a first Formant, the stored Formant frequency information for a first point of transition and for a second point of transition; and (c) interpolating a plurality of frequency values between the read Formant frequency information of the first point of transition and the read Formant frequency information of the second point of transition.

11. The method of claim 10, wherein said step (c) includes the sub-steps of:

(c-1) storing, for each time segment, a time length;

(c-2) reading the stored time length, Li, corresponding to the first time segment, i=1;

(c-3) determining, based upon the time length read in said step (c-2), a number of frequency values, n, to be interpolated;

(c-4) interpolating, for the first Formant, the number, n, of frequency values, each frequency value, F, being determined according to:

$$F=(F_{i+1}-F_i)n/L_i$$

where n=1 to n for respective ones of the frequency values, and $F_{i+1}$ and $F_i$ correspond to the frequency information for the second and first points of transition, respectively, read in said step (b).

12. The method of claim 10, wherein the plurality of frequency values obtained in said step (c) together form a first digital signal, said method further comprising the steps of:

(d) reading, for the first Formant, the stored bandwidth information for the first point of transition and for the second point of transition; and (e) interpolating a plurality of bandwidth values between the bandwidth information of the first and second points of transition read in said step (d), thereby forming a second digital signal.

13. The method of claim 12, wherein each of the frequency values obtained from said step (c) corresponds to a respective one of the bandwidth values obtained from said step (e), said method further comprising the steps of:

(f) for each frequency value and corresponding bandwidth value, filtering the frequency value and bandwidth value to produce a digital speech signal;

(g) converting the digital speech signal to an analog speech signal; and (h) outputting the analog speech signal.

14. The method of claim 13, wherein said step (h) includes the sub-step of:

(h-1) driving a speaker according to the analog speech signal.

15. The method of claim 14, wherein said step (c) includes the sub-steps of:

(c-1) storing, for each time segment, a time length;

(c-2) reading the stored time length, Li, corresponding to the first time segment, i=1;

(c-3) determining, based upon the time length read in said sub-step (c-2), a number of frequency values, n, to be interpolated;

(c-4) interpolating, for the first Formant, the number, n, of frequency values, each frequency value, F, being determined according to:

$$F=(F_{i+1}-F_i)n/L_i$$

where n=1 to n for respective ones of the frequency values, and $F_{i+1}$ and $F_i$ correspond to the frequency information for the second and first points of transition, respectively, read in said step (b); and said step (e) includes the sub-step of:

(e-1) interpolating, for the first Formant, the number, n, of bandwidth values, each bandwidth value, BW, being determined according to:

$$BW=(BW_{i+1}-BW_i)n/L_i$$

where n=1 to n for respective ones of the bandwidth values, and $BW_{i+1}$ and $BW_i$ correspond to the bandwidth information for the second and first points of transition, respectively, read in said step (d).

16. The method of claim 10, wherein the discrete time segments of said step (a) are segmented according to points of linear characteristic change of the Formants' frequencies.

* * * * *